US008498551B2

(12) United States Patent
Sato et al.

(10) Patent No.: US 8,498,551 B2
(45) Date of Patent: Jul. 30, 2013

(54) IMAGE FORMING APPARATUS

(71) Applicants: Shougo Sato, Seto (JP); Susumu Sakuma, Kasugai (JP)

(72) Inventors: Shougo Sato, Seto (JP); Susumu Sakuma, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/752,988

(22) Filed: Jan. 29, 2013

(65) Prior Publication Data

US 2013/0142555 A1 Jun. 6, 2013

Related U.S. Application Data

(63) Continuation of application No. 13/442,108, filed on Apr. 9, 2012, now Pat. No. 8,369,735, which is a continuation of application No. 13/172,440, filed on Jun. 29, 2011, now Pat. No. 8,175,490, which is a continuation of application No. 12/397,667, filed on Mar. 4, 2009, now Pat. No. 8,000,628.

(30) Foreign Application Priority Data

Mar. 5, 2008 (JP) ..... 2008-055542

(51) Int. Cl.
*G03G 15/16* (2006.01)

(52) U.S. Cl.
USPC ..... 399/101; 399/123; 399/343; 399/357; 399/360

(58) Field of Classification Search
USPC ..... 399/101, 123, 343, 357, 360
See application file for complete search history.

(56) References Cited

U.S. PATENT DOCUMENTS

| | | | | |
|---|---|---|---|---|
| 6,708,011 | B2 | 3/2004 | Nomura et al. | |
| 7,778,567 | B2 | 8/2010 | Igarashi et al. | |
| 7,899,355 | B2 | 3/2011 | Sakuma | |
| 2003/0053819 | A1 | 3/2003 | Nomura et al. | |
| 2006/0067734 | A1 | 3/2006 | Igarashi et al. | |
| 2008/0152378 | A1 | 6/2008 | Yamashita et al. | |
| 2009/0190955 | A1 | 7/2009 | Igarashi et al. | |
| 2009/0196652 | A1 * | 8/2009 | Sakuma | 399/123 |
| 2011/0142484 | A1 | 6/2011 | Sakuma | |

FOREIGN PATENT DOCUMENTS

| | | | |
|---|---|---|---|
| JP | 04-215668 | A | 8/1992 |
| JP | 05-257340 | A | 10/1993 |
| JP | 2002-006716 | A | 1/2002 |
| JP | 2003-015378 | A | 1/2003 |
| JP | 2004-021134 | A | 1/2004 |
| JP | 2006-098772 | A | 4/2006 |
| JP | 2006-276449 | A | 10/2006 |
| JP | 2007-218936 | A | 8/2007 |

OTHER PUBLICATIONS

Japanese Office Action dated Jun. 1, 2010 issued in Japanese Application No. 2008-055542, English Translation.

* cited by examiner

*Primary Examiner* — Ryan Walsh
(74) *Attorney, Agent, or Firm* — Banner & Witcoff, Ltd.

(57) ABSTRACT

An image forming apparatus includes: an image forming unit having a plurality of photoconductor drums arranged in tandem; an intermediate transfer belt arranged opposite to the photoconductor drums and configured to receive developer images formed on the photoconductor drums and to transfer the developer images onto a recording sheet; a cleaning unit comprising a cleaning member positioned in contact with the intermediate transfer belt and configured to collect substance adhering to the intermediate transfer belt, and a receptacle configured to store the substance collected by the cleaning member, wherein the cleaning unit is arranged on the same side as the image forming unit with respect to the intermediate transfer belt; and a support member configured to support the image forming unit and the cleaning unit and to be pulled out from a main body.

6 Claims, 8 Drawing Sheets

IMAGE FORMING APPARATUS

CROSS REFERENCE TO RELATED APPLICATIONS

This application is a continuation of U.S. application Ser. No. 13/442,108, filed Apr. 9, 2012, which is a continuation of U.S. application Ser. No. 13/172,440, filed Jun. 29, 2011 (now U.S. Pat. No. 8,175,490 B2, issued May 8, 2012), which is a continuation of U.S. application Ser. No. 12/397,667, filed Mar. 4, 2009 (now U.S. Pat. No. 8,000,628 B2, issued Aug. 16, 2011), which claims priority to Japanese Patent Application No. 2008-055542 filed on Mar. 5, 2008, the contents of each are hereby incorporated by reference into the present application.

BACKGROUND OF THE INVENTION

The present invention relates to an image forming apparatus such as a color laser printer, and in particular to an image forming apparatus including an intermediate transfer belt.

An image forming apparatus such as a laser printer is generally known, which comprises a plurality of development devices each containing different color toner, a plurality of photoconductor drums each of which is supplied with toner from a corresponding development device via a developing roller, a conveyor belt arranged opposite to the plurality of photoconductor drums, and a plurality of transfer devices configured to cause toner retained on the plurality of photoconductor drums to be attracted to the conveyor belt. In this image forming apparatus, the plurality of photoconductor drums are arranged in tandem, and a sheet of medium such as paper (hereinafter referred to as a sheet) is conveyed on the belt and passes between the plurality of photoconductor drums and the plurality of transfer devices, during which a transfer bias having the reverse polarity of the charged toner is applied to the transfer devices so that different color toner retained on the surfaces of the respective photoconductor drums is attracted by the transfer devices and continuously transferred onto the sheet to perform a color printing on the sheet.

Unlike the above image forming apparatus in which toner retained on the plurality of photoconductor drums is directly transferred onto a sheet, there is also known an image forming apparatus of an intermediate transfer type in which toner retained on each photoconductor drum is transferred onto an intermediate transfer belt to form a toner image and the toner image is then transferred from the intermediate transfer belt onto a sheet.

According to these image forming apparatuses, in order to ease maintenance of the photoconductor drums, each of the photoconductor drums for different colors is integrally held in a photoconductor drum unit, and this photoconductor drum unit is attached to or detached from a main body of the image forming apparatus. Further, in order to remove substance such as toner and paper dust adhering to the conveyor belt or the intermediate transfer belt (hereinafter these belts may be referred to as a belt) due to sheet jamming, etc., the image forming apparatus is also provided with a cleaning unit configured to contact with the belt to remove and collect the adhering substance.

For example, Japanese Laid-open Patent Publication No. 2006-98772, which corresponds to US 2006/0067734 A1, discloses an image forming apparatus in which a photoconductor drum unit is arranged above a conveyor belt and a cleaning unit is arranged at a lower position of the conveyor belt where a sheet does not pass through.

However, an image forming apparatus including a cleaning unit requires maintenance of the cleaning unit in order to dispose of adhering substance that has been removed and collected from the belt.

However, in the above image forming apparatus, because the cleaning unit is arranged below the belt, it is necessary to remove the belt during the maintenance of the cleaning unit. Therefore, the maintenance work becomes complicated and time-consuming.

Further, according to an arrangement where the photoconductor drum unit is arranged above the belt and the cleaning unit is arranged below the belt, the height of the image forming apparatus is increased and thus the overall size of the image forming apparatus is enlarged.

In view of the foregoing drawbacks, the present invention seeks to provide an image forming apparatus, which can ease the maintenance work of a cleaning unit and which can reduce the overall size of the image forming apparatus.

SUMMARY OF THE INVENTION

According to the present invention, an image forming apparatus comprises: an image forming unit including a plurality of photoconductor drums arranged in tandem; an intermediate transfer belt arranged opposite to the plurality of photoconductor drums and configured to receive developer images formed on the photoconductor drums and to transfer the developer image onto a recording sheet; a cleaning unit including a cleaning member positioned in contact with the intermediate transfer belt and configured to collect substance adhering to the intermediate transfer belt, and a receptacle configured to store the substance collected by the cleaning member, wherein the cleaning unit is arranged on the same side as the image forming unit with respect to the intermediate transfer belt; and a support member configured to support the image forming unit and the cleaning unit and to be pulled out from a main body of the apparatus together with the image forming unit and the cleaning unit.

According to this image forming apparatus, because the cleaning unit for the intermediate transfer belt is arranged on the same side as the image forming unit with respect to the intermediate transfer belt, the height of the image forming apparatus can be reduced. Further, because the image forming unit and the cleaning unit are supported in the support member which is configured to be pulled out from the main body of the apparatus together with the image forming unit and the cleaning unit, it is possible to remove the cleaning member together with the image forming unit. Therefore, the maintenance of the cleaning unit can be performed without the need for removing the intermediate transfer belt and by the same manner of operations as the image forming unit is attached to or detached from the main body of the apparatus.

According to the present invention, the maintenance work for the cleaning unit can be readily performed and the overall size of the image forming apparatus can be reduced.

BRIEF DESCRIPTION OF THE DRAWINGS

Other objects and aspects of the present invention will become more apparent by describing in detail illustrative, non-limiting embodiments thereof with reference to the accompanying drawings, in which.

DETAILED DESCRIPTION OF THE INVENTION

Preferred embodiments of the present invention will be described in detail with reference to the attached drawings.

Figure 1:
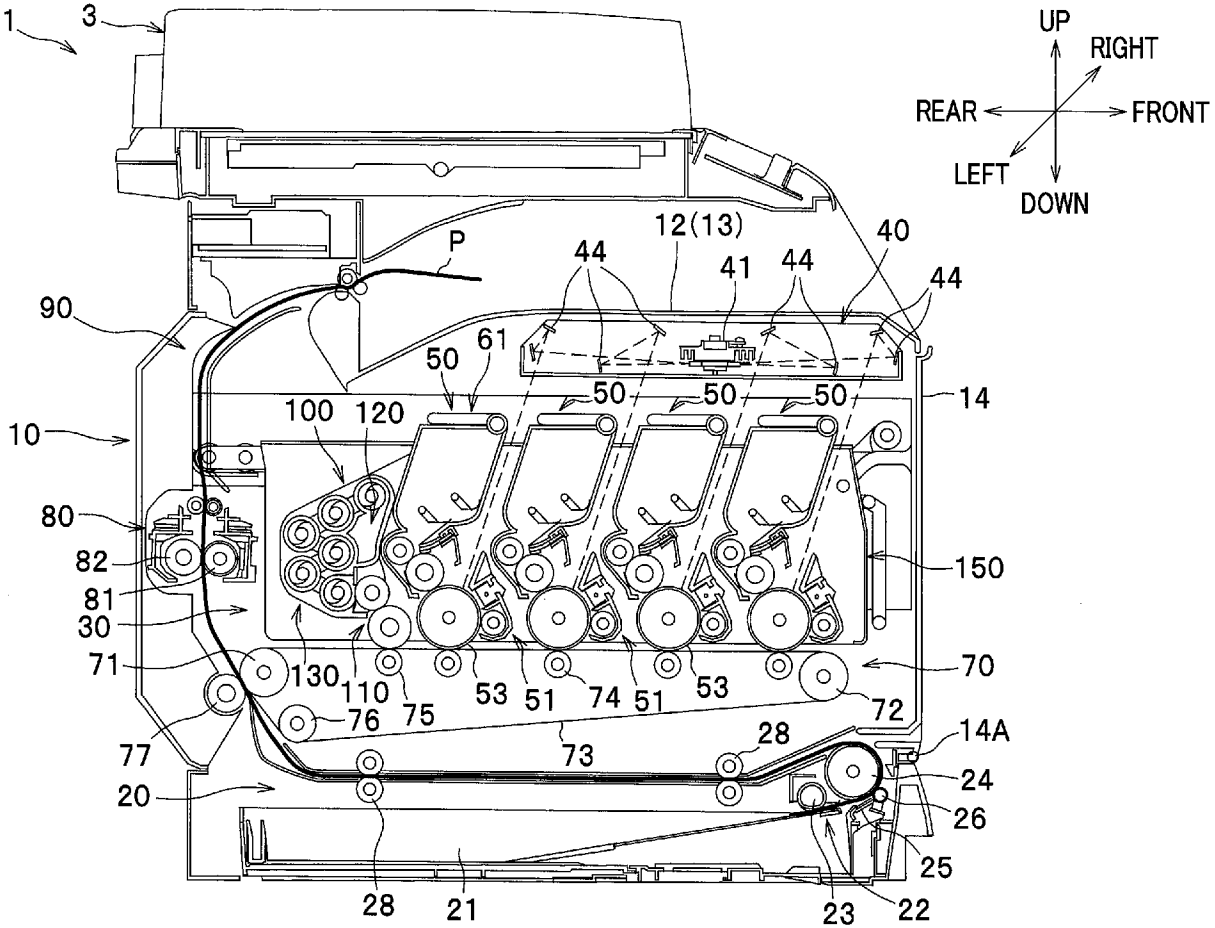
FIG. 1 is a sectional view showing the overall configuration of a color printer as an example of an image forming apparatus according to a first embodiment of the present invention.

In the following description, unless otherwise stated, directions of a color printer refer to the directions as seen from a user facing the color printer during its use. To be more specific, referring to FIG. 1, a right-side direction and a left-side direction of the color printer are referred to as a "front side" and a "rear side", respectively. Also, a direction away from a viewer of FIG. 1 is referred to as a "right side", and a direction toward the viewer of FIG. 1 as a "left side". An upper and lower direction in FIG. 1 is referred to as a "vertical direction" or an "upper and lower direction" as it is.

First Embodiment

As seen in FIG. 1, a color printer 1 has a main body 10. The color printer 1 is provided with a sheet feeding unit 20 configured to feed a sheet of paper P (hereinafter simply referred to as a "sheet" P) as an example of a recording sheet, an image forming device 30 configured to form an image on the sheet P supplied from the sheet feeding unit 20, and a sheet output unit 90 configured to discharge the sheet P having the image thereon from the main body 10, which are arranged in the main body 10. The color printer 1 is also provided with a flat-bed scanner 3 at an upper part of the main body 10.

An upper cover 12 is provided at an upper part of the main body 10. Also, a front cover 14 is provided at a front part of the main body 10. The front cover 14 is pivotally supported on a hinge 14A that is provided at a lower part of the main body 10. The front cover 14 is swung open and closed in the front-and-rear direction around the hinge 14A. The upper surface of the upper cover 12 provides a sheet output tray 13 for receiving and stacking sheets P discharged from the main body 10. A scanner unit 40 is arranged below the upper cover 12.

The sheet feeding unit 20 is arranged at a lower part within the main body 10, and mainly includes a sheet feed tray 21 configured to be attached to or detached from the main body 10, and a sheet feed mechanism 22 configured to convey a sheet P from the sheet feed tray 21 to the image forming device 30. The sheet feed mechanism 22 is positioned in front of the sheet feed tray 21, and mainly includes a feed roller 23, a separation roller 24, and a separation pad 25.

The sheet feeding unit 20 as constructed above separates a stack of sheets P stored in the sheet feed tray 21 and conveys a sheet P on one-by-one basis upwardly toward the image forming device 30, during which the sheet P passes between a paper dust removing roller 26 and a separation roller 24 to remove paper dust from the sheet P and thereafter the sheet conveyance direction of the sheet P is reversed in the rearward direction so that the sheet is conveyed by conveyance rollers 28.

The image forming device 30 mainly includes a scanner unit 40, four process cartridges 50 as an example of an image forming unit, a cleaning unit 100, a transfer unit 70, and a fixing unit 80.

The four process cartridges 50 and the cleaning unit 100 are mounted to a support member 150 which is attached to or detached from the main body 10. The support member 150 is formed, for example, as a bottomless frame. The support member 150 can be pulled out from the main body 10 with the front cover 14 being opened.

The scanner unit 40 is arranged at an upper part within the main body 10, and includes laser emitting portions (not shown), a polygon minor 41 that is driven to spin at high speeds, a plurality of lenses (not shown), and a plurality of reflecting mirrors 44. A laser beam is emitted from the laser emitting portion based on image data. As seen in FIG. 1, the laser beam associated with one of the colors including, for example, cyan, magenta, yellow, and black is reflected by or passes through the polygon minor 41, the reflecting mirrors 44 associated with the color, and the lens 43 associated with the color in this order. Thereafter, the surface of the photoconductor drum 53 of the corresponding process cartridge 50 is illuminated with the laser beam (i.e., scanned at a high speed).

Figure 2:
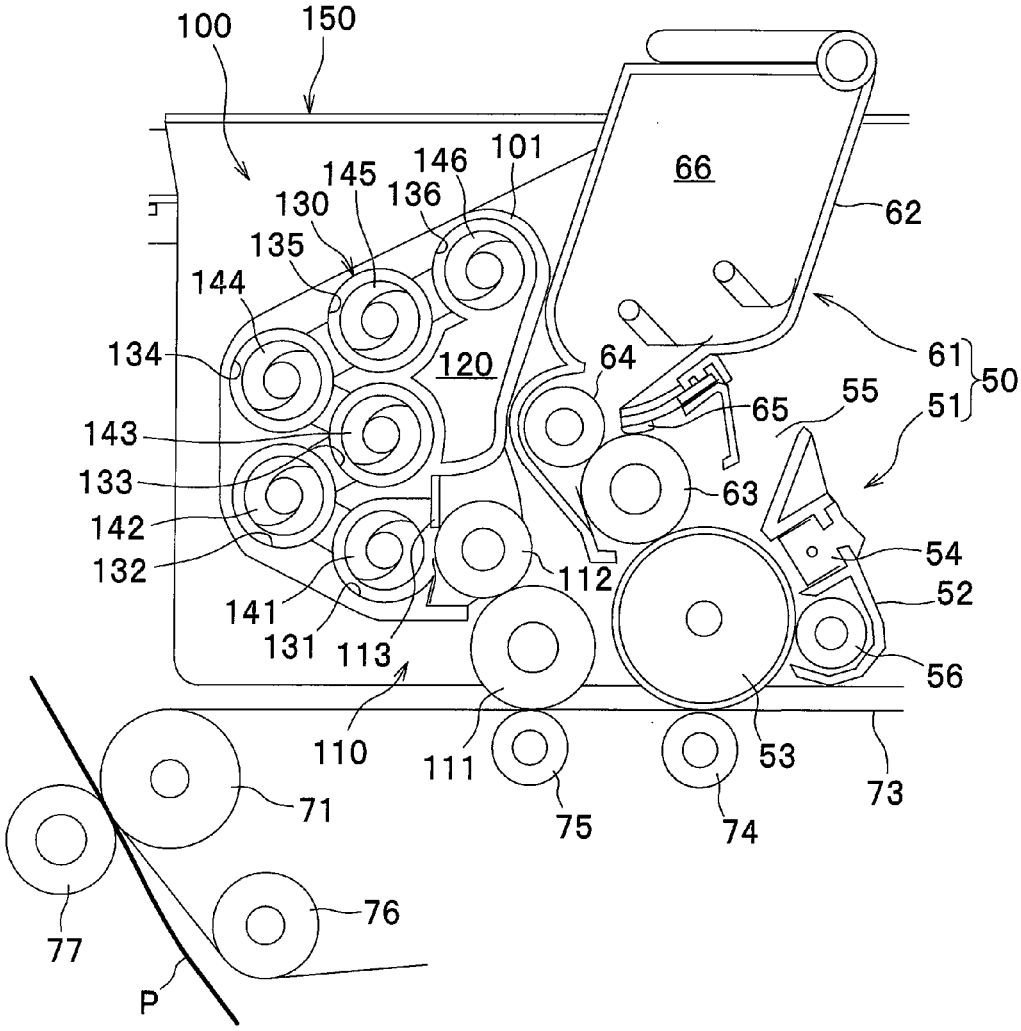
FIG. 2 is an enlarged sectional view showing main parts of a process cartridge and a cleaning unit.

The process cartridges 50 are positioned between the scanner unit 40 and the transfer unit 70 and arranged in line along the front-and-rear direction. As seen in FIG. 2, each of the process cartridges 50 includes a photoconductor cartridge 51 and a developing cartridge 61 detachably attached to the photoconductor cartridge 51. The process cartridges 50 are detachably mounted to the support member 150.

The photoconductor cartridge 51 mainly includes a drum frame 52, a photoconductor drum 53 rotatably supported in the drum frame 52, a charger 54, and a cleaning roller 56.

The drum frame 52 is configured such that when the developing cartridge 61 is attached to the photoconductor cartridge 51, an exposure opening 55 is defined between the developing cartridge 61 and the photoconductor cartridge 51, through which opening the photoconductor drum 53 can be seen from above. A laser beam coming from the scanner unit 40 through the exposure opening 55 strikes the surface of the photoconductor drum 53. The cleaning roller 56 is rotatable and positioned in contact with the photoconductor drum 53. When a predetermined electric voltage is applied to the cleaning roller 56, the cleaning roller 56 temporarily collects and retains toner T that has remained on the photoconductor drum 53 after toner T is transferred onto the sheet P.

The developing cartridge 61 includes a developer frame 62, a developing roller 63 and a supply roller 64 rotatably supported in the developer frame 62, a doctor blade 65, and a toner storage chamber 66 for storing toner T.

It is noted that each of the developing cartridges 61 is substantially the same in construction except for the color of toner (developer) T stored in the toner storage chamber 66.

As seen in FIG. 1, the transfer unit 70 is positioned between the sheet feeding unit 20 and the process cartridges 50. The transfer unit 70 mainly includes a drive roller 71, a first driven roller 72, a second driven roller 76, an intermediate transfer belt 73, intermediate transfer rollers 74, and a secondary transfer roller 77.

The drive roller 71 and the first driven roller 72 are positioned parallel to each other and spaced apart in the front-and-rear direction. The second driven roller 76 is positioned below and diagonally forward of the drive roller 71. The intermediate transfer belt 73 in the form of an endless belt is looped around the drive roller 71, the first driven roller 72, and the second driven roller 76. The outer surface of the intermediate transfer belt 73 contacts with the photoconductor drums 53. Four intermediate transfer rollers 74 are positioned inside the intermediate transfer belt 73 opposite to the corresponding photoconductor drums 53 with the intermediate transfer belt 73 being interposed therebetween. A transfer bias is applied to each intermediate transfer roller 74 by a constant-current control during the transfer of toner T onto a sheet P.

The secondary transfer roller 77 is positioned outside the intermediate transfer belt 73 opposite to the drive roller 71. A sheet P contacts with the intermediate transfer belt 73 at a position between the drive roller 71 and the secondary transfer roller 77. Applying a transfer bias to the secondary transfer roller 77 causes a toner image carried on the intermediate transfer belt 73 to be transferred onto the sheet P.

A backup roller 75 is positioned inside the intermediate transfer belt 73 opposite to a cleaning roller 111 of a cleaning unit 100 (see FIG. 2).

The fixing unit 80 is arranged behind the process cartridges 50, the transfer unit 70, and the cleaning unit 100. The fixing unit 80 includes a heating roller 81, and a pressure roller 82 positioned opposite to the heating roller 81 and pressing the heating roller 81.

The cleaning unit 100 collects or removes toner T adhering to (remaining on) the intermediate transfer belt 73 as an example of adhering substance. The cleaning unit 100 is positioned upstream from and parallel to the plurality of process cartridges 50 as seen in a travelling direction of the intermediate transfer belt 73. In other words, the cleaning unit 100 is arranged above the upper flat surface of the intermediate transfer belt 73 (see FIG. 1) that extends horizontally between the drive roller 71 and the first driven roller 72. The cleaning unit 100 includes a cleaner portion 110 configured to collect toner T adhering to the intermediate transfer belt 73, a waste toner box 120 as an example of a receptacle for storing the collected toner T, and a waste toner carrier unit 130 configured to carry the toner T from the cleaner portion 110 to the waste toner box 120. The cleaning unit 100 (see FIG. 2) is detachably mounted to the support member 150. However, the cleaning roller 111 is fixed to the support frame 150.

It is noted that toner T to be removed by the cleaner portion 110 is toner remaining on the intermediate transfer belt 73 after a toner image is transferred onto a sheet P by means of the secondary transfer roller 77.

Other than paper jamming, toner T adheres to the intermediate transfer belt 73 during a so-called patch test for testing shading, color tone, and color shift of printed patterns.

As seen in FIG. 2, the cleaner portion 110 includes a cleaning roller 111 as an example of a cleaning member, a collecting roller 112, and a blade 113.

The cleaning roller 111 contacts with the intermediate transfer belt 73 to remove toner T from the intermediate transfer belt 73. The cleaning roller 111 is a conductive foamed roller. The cleaning roller 111 consists of a roller shaft made of metal, and a roller member coating the roller shaft and made of a conductive foamed material such as silicone foam and urethane foam. The cleaning roller 111 always presses the intermediate transfer belt 73 by pinching the intermediate transfer belt 73 between the cleaning roller 111 and the backup roller 75. The cleaning roller 111 is rotatably supported at each side wall (right and left side walls) of the support member 150 and is allowed to rotate in the clockwise direction of FIG. 2.

The collecting roller 112 is made of a hard material such as metal and pressed against the cleaning roller 111. The collecting roller 112 is rotatable and arranged upward at the rear of the cleaning roller 111. The blade 113 is provided at the rear of the collecting roller 112. The blade 113 contacts with the collecting roller 112 with a pressure and scrapes toner T off from the surface of the collecting roller 112.

Figure 3A:
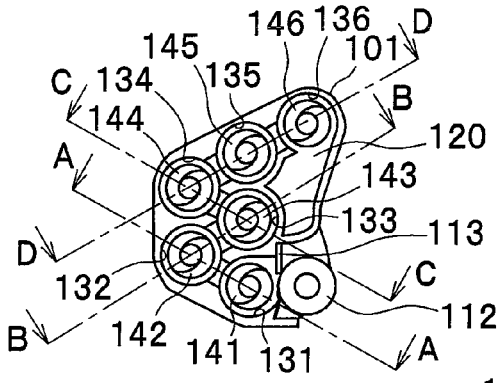
FIG. 3A is a side view of the cleaning unit.

As seen in FIGS. 2 and 3A, the waste toner carrier unit 130 includes first to sixth carrying passages 131-136 extending in the right-and-left directions, and first to sixth augers 141-146 each of which is rotatably provided inside the corresponding carrying passage.

The first carrying passage 131 has an opening that extends along the collecting roller 112. The blade 113 is positioned at the opening. The blade 113 scrapes off waste toner T into the first carrying passage 131, and the waste toner T is then carried in the leftward direction by the first auger 141.

Figure 3B:
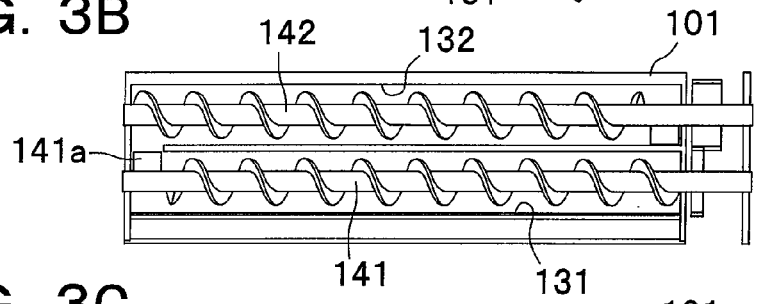
FIG. 3B is a sectional view taken along the line A-A of FIG. 3A.
Figure 3C:
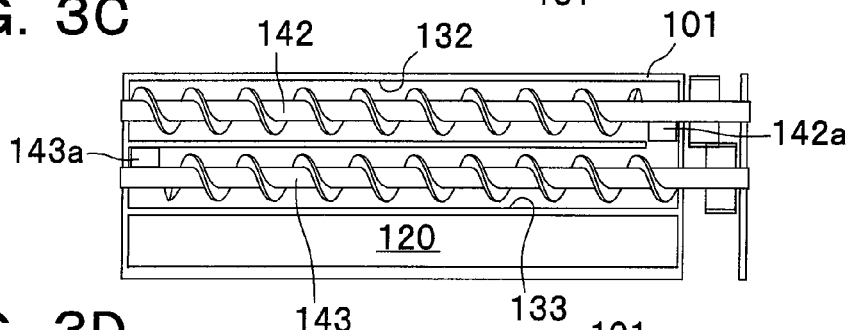
FIG. 3C is a sectional view taken along the line B-B of FIG. 3A.
Figure 3D:
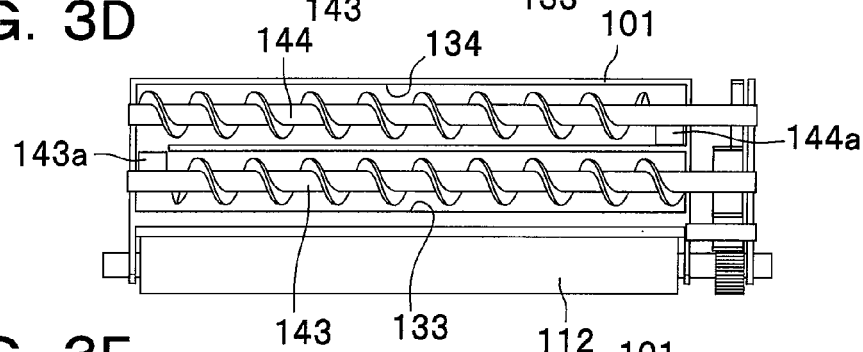
FIG. 3D is a sectional view taken along the line C-C of FIG. 3A.
Figure 3E:
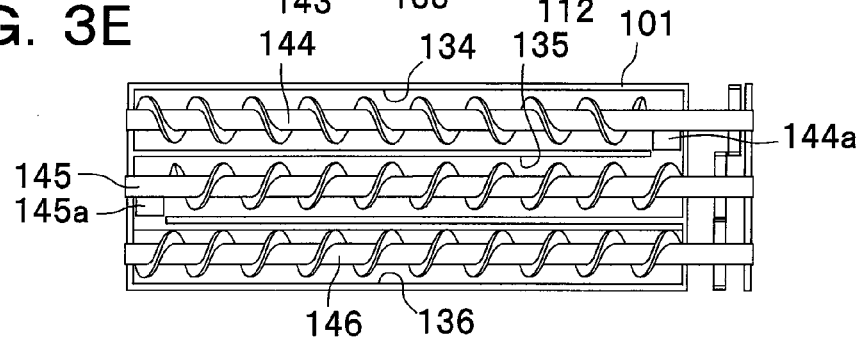
FIG. 3E is a sectional view taken along the line D-D of FIG. 3A.

As seen in FIG. 3B, the left end of the first carrying passage 131 is in communication with the second carrying passage 132, and as seen in FIG. 3C, the right end of the second carrying passage 132 is in communication with the third carrying passage 133. As seen in FIG. 3D, the left end of the third carrying passage 133 is in communication with the fourth carrying passage 134, and as seen in FIG. 3E, the right end of the fourth carrying passage 134 is in communication with the fifth carrying passage 135, and the left end of the fifth carrying passage 135 is in communication with the sixth carrying passage 136.

As seen in FIG. 3B, the first auger 141 has a vane 141*a* at the left end thereof. The first auger 141 carries waste toner T toward the left end, and the vane 141*a* delivers the waste toner T into the second carrying passage 132. Similarly, each of the second to fifth augers 142-145 has a vane 142*a*, 143*a*, 144*a*, and 145*a* at either right or left end thereof. Further, each of the first to sixth augers 141-146 has a gear at its right end for rotating the auger in a predetermined direction.

As best seen in FIGS. 2 and 3A, the sixth carrying passage 136 is formed above the waste toner box 120. The sixth carrying passage 136 has an opening that extends along the right-and-left direction and opens toward the waste toner box 120.

The waste toner box 120 provides a chamber for storing collected waste toner T. The waste toner box 120 is formed by dividing a frame 101 that defines a frame-work of the cleaning unit 100 into a predetermined shape.

Figure 5:
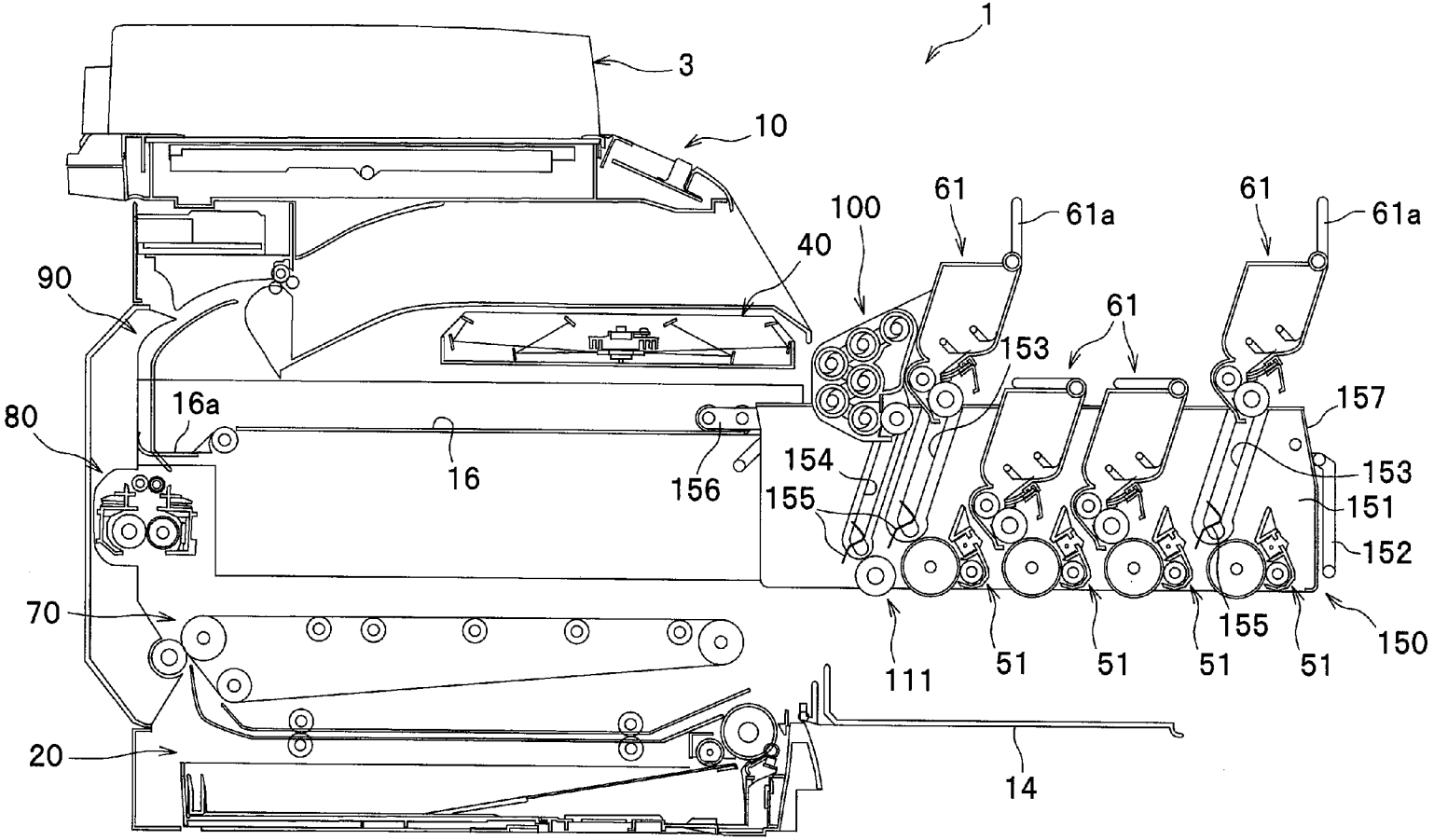
FIG. 5 is a sectional view showing a state in which the cleaning unit and a developing cartridge are being pulled out from the support member.

Like the waste toner box 120, the first to sixth carrying passages 131-136 are also formed by dividing the frame 101 into predetermined shapes. According to the first embodiment, as seen in FIG. 5, the frame 101 is integrally formed with an upstream-most developing cartridge 61 that is located at the most upstream position as seen in the traveling direction of the intermediate transfer belt 73.

The image forming operation of the color printer 1 will be described below with reference to FIGS. 1 and 2.

As seen in FIGS. 1 and 2, according to the image forming unit 30, the surface of each photoconductor drum 53 is positively and uniformly charged by the corresponding charger 54, and is exposed to a laser beam emitted from the scanner unit 40 in accordance with a subject color of the photoconductor drum 53. Therefore, the electric potential of the exposed area lowers so that an electrostatic latent image associated with an image data is formed on the surface of the photoconductor drum 53.

When the supply roller 64 rotates, toner T stored in the toner storage chamber 66 is supplied to the developing roller 63, and thereafter by the rotation of the developing roller 63 the toner T moves between the developing roller 63 and the doctor blade 65 at which position the toner T is carried on the developing roller 63 as a thin layer having a constant thickness. It is noted that the toner T carried on the surface of the developing roller 63 is charged positively between the supply roller 64 and the developing roller 63 and also between the developing roller 63 and the doctor blade 65.

The toner T carried on the developing roller 63 moves onto the latent image that is formed on the photoconductor drum 53 when the developing roller 63 opposite to the photoconductor drum 53 contacts with the surface of the photoconductor drum 53. Therefore, the toner T is selectively supplied on the surface of the photoconductor drum 53 to visualize the latent image. A toner image is formed by this reversal process.

Toner images formed on the plurality of photoconductor drums 53 are transferred onto the intermediate transfer belt 73 while the intermediate transfer belt 73 passes between the photoconductor drums 53 and the corresponding intermediate transfer rollers 74. As the intermediate transfer belt 73 rotates, the resulting toner image transferred onto the intermediate transfer belt 73 moves and reaches to the contacting position between the drive roller 71 and the secondary transfer roller 77 at which position the intermediate transfer belt 73 contacts with a sheet P.

At this time, the sheet feed mechanism 22 conveys a sheet P between the drive roller 71 and the secondary transfer roller 77, so that the resulting toner image carried on the intermediate transfer belt 73 is transferred onto the sheet P.

When the sheet P passes between the heating roller 81 and the pressure roller 82, the toner image that has been transferred onto the sheet P is thermally fixed.

As seen in FIG. 1, the sheet output unit 90 includes plural pairs of conveyance rollers along an output-side sheet conveyance passage and at the discharge opening for a sheet P. The sheet P onto which the toner image has been transferred and fixed by heat is conveyed along the output-side sheet conveyance passage by means of the conveyance rollers, discharged from the main body 10, and stacked on the sheet output tray 13.

Operation of the cleaning unit 100 will be described below with reference to FIGS. 1 and 2.

As seen in the travelling direction of the intermediate transfer belt 73, the cleaning roller 111 is positioned downstream from the drive roller 71 and upstream from the photoconductor drums 53. At this position, the cleaning roller 111 always contacts with the intermediate transfer belt 73. The cleaning roller 111 rotates in the clockwise direction in FIGS. 1 and 2 so that the travelling direction of the cleaning roller 111 is opposite to the travelling direction of the intermediate transfer belt 73 at their contacting position.

The roller shaft of the backup roller 75 is electrically earthed. A negative bias is applied to the cleaning roller 111, and a negative bias lower than that applied to the cleaning roller 111 is applied to the collecting roller 112. Therefore, toner T adhering to the intermediate transfer belt 73 moves to the cleaning roller 111 by the action of the bias attraction force and the contacting force of the cleaning roller 111 at around the opposing position of the cleaning roller 111 and the backup roller 75. The toner T carried on the cleaning roller 111 is then moved to the collecting roller 112 by the action of the bias attraction force, and thereafter the toner T carried on the collecting roller 112 is scraped off by the blade 113 and finally supplied into the first carrying passage 131. The toner T supplied into the first carrying passage 131 is carried to the second carrying passage 132 by the first auger 141. Accordingly, the collected toner T is carried through the first to sixth carrying passages 131-136 in this order and supplied into the waste toner box 120.

During this process, a predetermined electric voltage (i.e., a positive bias for moving positively charged toner T toward the photoconductor drum 53) is applied to the cleaning roller 56 provided in the photoconductor cartridge 51 for a predetermined period of time so that the toner T is returned to the photoconductor drum 53. A negative transfer bias is applied to the intermediate transfer roller 74 so that the toner T that has been returned to the surface of the photoconductor drum 53 is moved and discharged onto the intermediate transfer belt 73. Thereafter, the toner T moves to the cleaning roller 111 by the rotation of the intermediate transfer belt 73 and is collected by the cleaning roller 111. The collected toner T is stored in the waste toner box 120. Accordingly, removal of the toner T that is temporarily retained by the cleaning roller 56 is completed. This series of operations is called as a "cleaning mode."

Next, the scanner unit 40 forms an electrostatic latent image having a predetermined patch pattern on the surface of each photoconductor drum 53. This latent image is developed using toner T carried on the developing roller 63. The patch pattern developed by the toner T is then transferred on the intermediate transfer belt 73 by applying a negative transfer bias to the corresponding intermediate transfer roller 74.

The resulting patch pattern passes through a patch pattern sensor (not shown) by the rotation of the intermediate transfer belt 73. The patch pattern sensor performs various measurements. Although not shown in the drawings, the patch pattern sensor is arranged below the first driven roller 72 at a position opposite to the first driven roller 72 with the intermediate transfer belt 73 interposed therebetween. The patch pattern sensor comprises a light emitting element and a light receiving element, and measures, for example, image density and color shift between respective colors.

The toner T forming the patch pattern goes around on the intermediate transfer belt 73, and is collected by the cleaning roller 111 and stored in the waste toner box 120. This series of operations is called as a "patch pattern measurement mode."

These two modes of operations including the cleaning mode and the patch pattern measurement mode are referred to as a series of start-up operations implemented immediately after turning on the main power switch and immediately after opening and closing the front cover.

Figure 4:
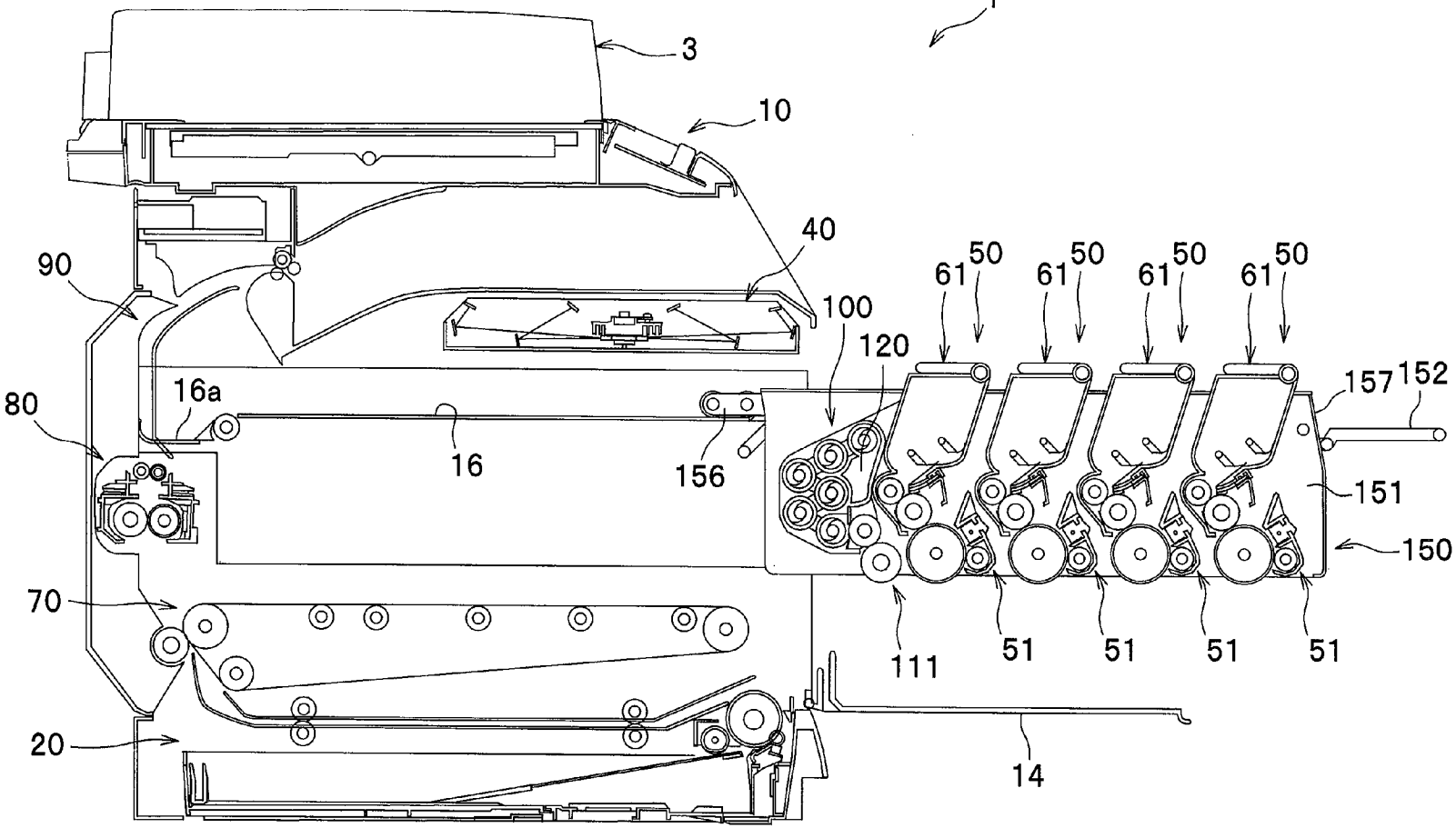
FIG. 4 is a sectional view showing a state in which a support member has been pulled out.

With reference to FIGS. 4 and 5, the maintenance of the cleaning unit 100 will be described.

As seen in FIGS. 4 and 5, the support member 150 is configured to support the four process cartridges 50 and the cleaning unit 100 such that they are aligned in the front-and-rear direction. The support member 150 can be pulled out from the main body 10 of the color printer 1. The support member 150 is formed as a bottomless frame, and a grip portion 152 is pivotally provided at the front wall 157 of the support member 150.

The photoconductor cartridges 51 are fixed, for example, by screws between the right and left side walls 151 of the support member 150 (only the right side wall is shown in the figures), and the developing cartridges 61 are detachably mounted to the support member 150 between these side walls 151. A guide groove 153 is formed in the inner surface of each side wall 151, which guides insertion and removal of the developing cartridge 61.

The cleaning roller 111 is rotatably fixed between the right and left side walls 151 of the support member 150. The cleaning unit 100 except for the cleaning roller 111 is detachably mounted to the support member 150. A guide groove 154 is formed in the inner surface of each side wall 151, which guides insertion and removal of the cleaning unit 100.

The guide grooves 153, 154 extend diagonally backward from the upper part toward the lower part of the side wall 151, and tilt forward at the lower end portion of the grooves 153, 154 toward the photoconductor cartridge 51. Provided adjacently to the lower end portions of the guide grooves 153, 154 are spring members 155 which urge the corresponding developing cartridges 61 toward the photoconductor cartridge 51 and a spring member 155 which urges the moving parts of the cleaning unit 100 toward the cleaning roller 111.

Guide rollers 156 are provided at the rear end of each side wall 151, extending outward from the side wall 151. The guide rollers 156 guide the support member 150 upon its insertion into and removal from the main body 10. Meanwhile, a guide rail 16 engageable with the guide rollers 156 is provided at an inner surface of each side wall of the main body 10. A rear end portion 16*a* of the guide rail 16 is one step lower than the rest of the guide rail 16. Because the guide rollers 156 slide along the guide rail 16, the support member 150 can be smoothly inserted into or pulled out from the main body 10 of the color printer 1.

As seen in FIG. 4, when the user performs the maintenance of the cleaning unit 100, the support member 150 is pulled out from the main body 10 of the color printer 1 after the front cover 14 is opened. By this operation, the four process cartridges 50 and the cleaning unit 100 which are mounted to the support member 150 are pulled out together from the main body 10, so that the four photoconductor drums 53 and the cleaning roller 111 are away from the intermediate transfer belt 73. When the user pulls out the support member 150, the guide roller 156 moves up by one step from the rear end portion 16*a* of the guide rail 16, so that the support member 150 entirely moves up. Therefore, it is possible to prevent the photoconductor cartridges 51 from frictionally contacting with the intermediate transfer belt 73.

Thereafter, as shown in FIG. 5, the cleaning unit 100 is removed from the support member 150 so as to replace it with a new cleaning unit 100 or to dispose of toner T stored in the waste toner box 120.

According to the first embodiment, the cleaning unit 100 except for the cleaning roller 111 is formed integrally with the upstream-most developing cartridge 61. Therefore, the cleaning unit 100 can be attached to or detached from the support member 150 together with the developing cartridge 61.

As with the maintenance of the cleaning unit 100, when the user performs the maintenance of the developing cartridge 61, he can pull out the support member 150 with the front cover 14 being opened. Thereafter, the user grasps a grip portion 61*a* of the developing cartridge 61 and pulls out the developing cartridge 61 from the support member 150 to replace it with a new developing cartridge 61.

According to the color printer 1 as constructed above, the maintenance of the cleaning unit 100 can be performed by the same manner of operations as that of the process cartridge 50. In other words, the maintenance of the cleaning unit 100 can be readily performed after a simple operation of pulling out the support member 150 in a direction parallel to the upper surface of the intermediate transfer belt 73.

Further, because the cleaning unit 100 is arranged on the same side as the four process cartridges 50 with respect to the intermediate transfer belt 73, the height of the color printer 1 can be reduced by the height of the cleaning unit 100 compared to the conventional image forming apparatus.

In the color printer 1 according to this embodiment, the cleaning unit 100 is positioned upstream from the process cartridges 50 as seen in the traveling direction of the intermediate transfer belt 73. Therefore, the process cartridges 50 form a toner image on the intermediate transfer belt 73 after the cleaning unit 100 removes adhering substance from the intermediate transfer belt 73. This can improve the quality of the toner image.

Further, the cleaning unit 100 is positioned upstream from the process cartridges 50 and also downstream from the drive roller 71 at which the toner image is transferred onto a sheet P. Therefore, the cleaning roller 111 can always be placed in contact with the intermediate transfer belt 73.

According to the first embodiment, except for the cleaning roller 111, the cleaning unit 100 (including the waste toner box 120) is integrally formed with the upstream-most developing cartridge 61, so that the waste toner box 120 of the cleaning unit 100 is replaced at the same time as the upstream-most developing cartridge 61 is replaced. Therefore, it is not necessary to dispose of waste toner T separately. Usually, the maintenance cycle for the waste toner box 120 is longer than the replacement cycle for the developing cartridge 61. Therefore, it is not necessary to pay attention to the maintenance of the waste toner box 120, allowing the waste toner box 120 to be substantially considered as a maintenance-free element.

Further, according to the first embodiment, the cleaning unit 100 is replaceable with a new one with the cleaning roller 111 fixed (remaining) in the support member 150. This is economically advantageous. The process cartridge 50 is also replaceable with a new one with the photoconductor cartridge 51 mounted to (remaining in) the support member 150. This is economically advantageous as well.

According to the first embodiment, the developing cartridges 61 and the cleaning unit 100 can be inserted into or pulled out from the support frame 150 in a direction (i.e., vertical direction) different from the pull-out direction (i.e., front-and-rear direction) of the support member 150. This can prevent the developing cartridge(s) 61 and/or the cleaning unit 100 from coming off and popping out from the support member 150 due to the reaction at a time when the user pulls out the support member 150 from the main body 10 of the color printer 1.

Second Embodiment

A second embodiment of the present invention will be described below. In the following description, parts different from those employed in the first embodiment will be mainly described, and like or similar parts will be denoted by the same reference numerals and the same names as those in the first embodiment and description thereof will be omitted or briefly stated.

Figure 6:
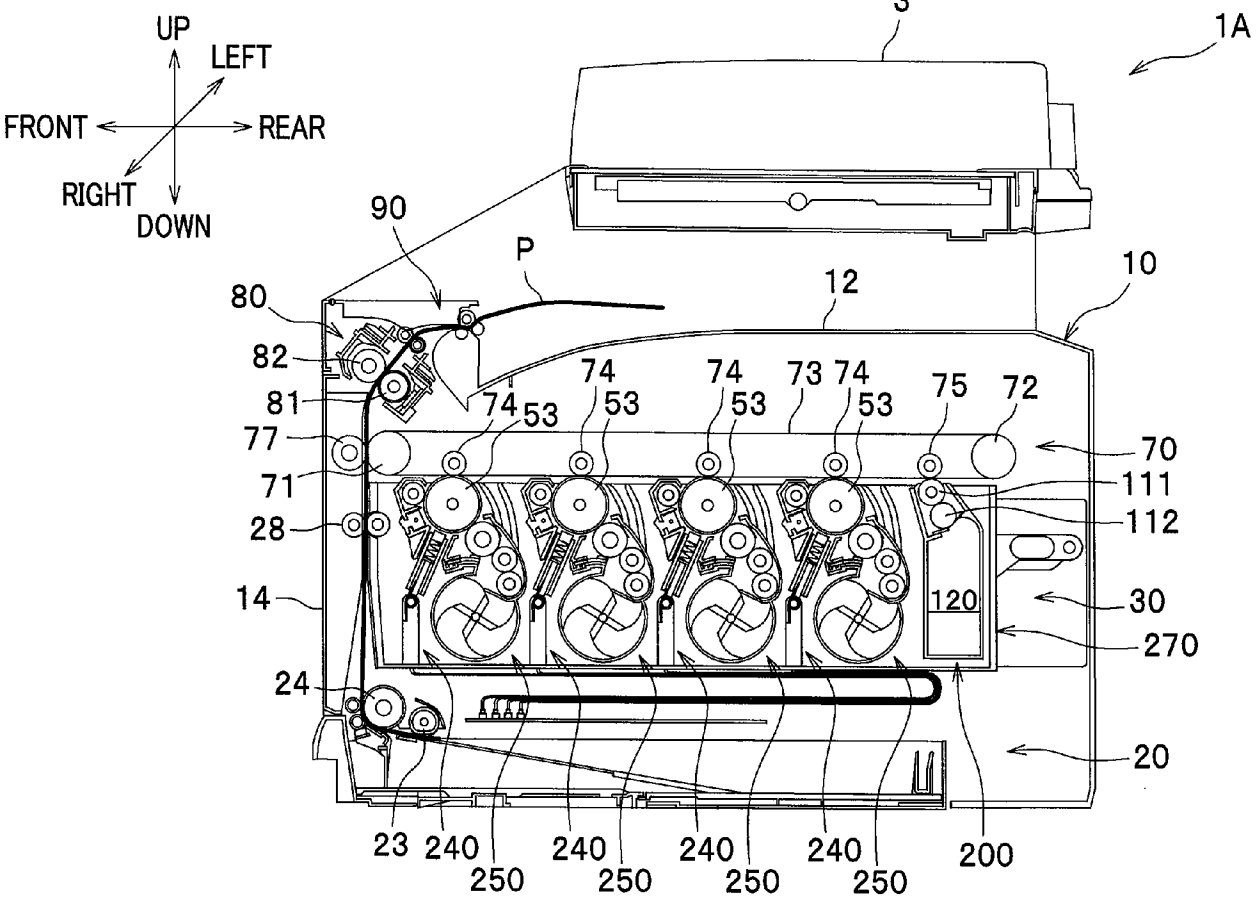
FIG. 6 is a sectional view of the overall configuration of a color printer according to a second embodiment of the present invention.

In the following description, unless otherwise stated, directions of a color printer refer to the directions as seen from a user facing the color printer during its use. To be more specific, referring to FIG. 6, a left-side direction and a right-side direction of the color printer are referred to as a "front side" and a "rear side", respectively. Also, a direction away from a viewer of FIG. 6 is referred to as a "left side", and a direction toward the viewer of FIG. 1 as a "right side". An upper and lower direction in FIG. 6 is referred to as a "vertical direction" or an "upper and lower direction" as it is.

As seen in FIG. 6A, a color printer 1A according to the second embodiment is different from that of the first embodiment in that a support member 270 is arranged below the intermediate transfer belt 73. The support member 270 supports four process cartridges 250 and a cleaning unit 200 that are arranged in tandem.

Further, in the color printer 1A according to the second embodiment, the construction of the process cartridge 250 and the construction of the cleaning unit 200 are different from those of the first embodiment.

Moreover, the color printer 1A according to the second embodiment is different from the color printer 1 according to the first embodiment in that four LED units 240 are mounted to the support member 270. Each LED unit 240 is employed for forming an electrostatic latent image on a corresponding photoconductor drum 53.

As best seen in FIG. 6, the color printer 1A has a main body 10. A sheet feeding unit 20 configured to feed a sheet P as an example of a recording sheet, an image forming device 30 configured to form an image on the sheet P supplied from the sheet feeding unit 20, and a sheet output unit 90 configured to discharge the sheet P having the image thereon from the main body 10 are arranged in the main body 10. The color printer 1A is also provided with a flat-bed scanner 3 at an upper part of the main body 10.

The image forming device 30 mainly includes four LED units 240, four process cartridges 250 as an example of an image forming unit, a cleaning unit 200, a transfer unit 70, and a fixing unit 80.

Of these parts of the image forming device 30, the four LED units 240, the four process cartridges 250, and the cleaning unit 200 are mounted to the support member 270 which is attached to or detached from the main body 10 of the color printer 1A. As described previously, the support member 270 is arranged below the transfer unit 70.

The support member 270 is a box-like member with the top-side thereof removed to open. The support member 270 can be pulled out from the main body 10 with the front cover 14 provided at the front-side of the main body 10 being opened.

Figure 7:
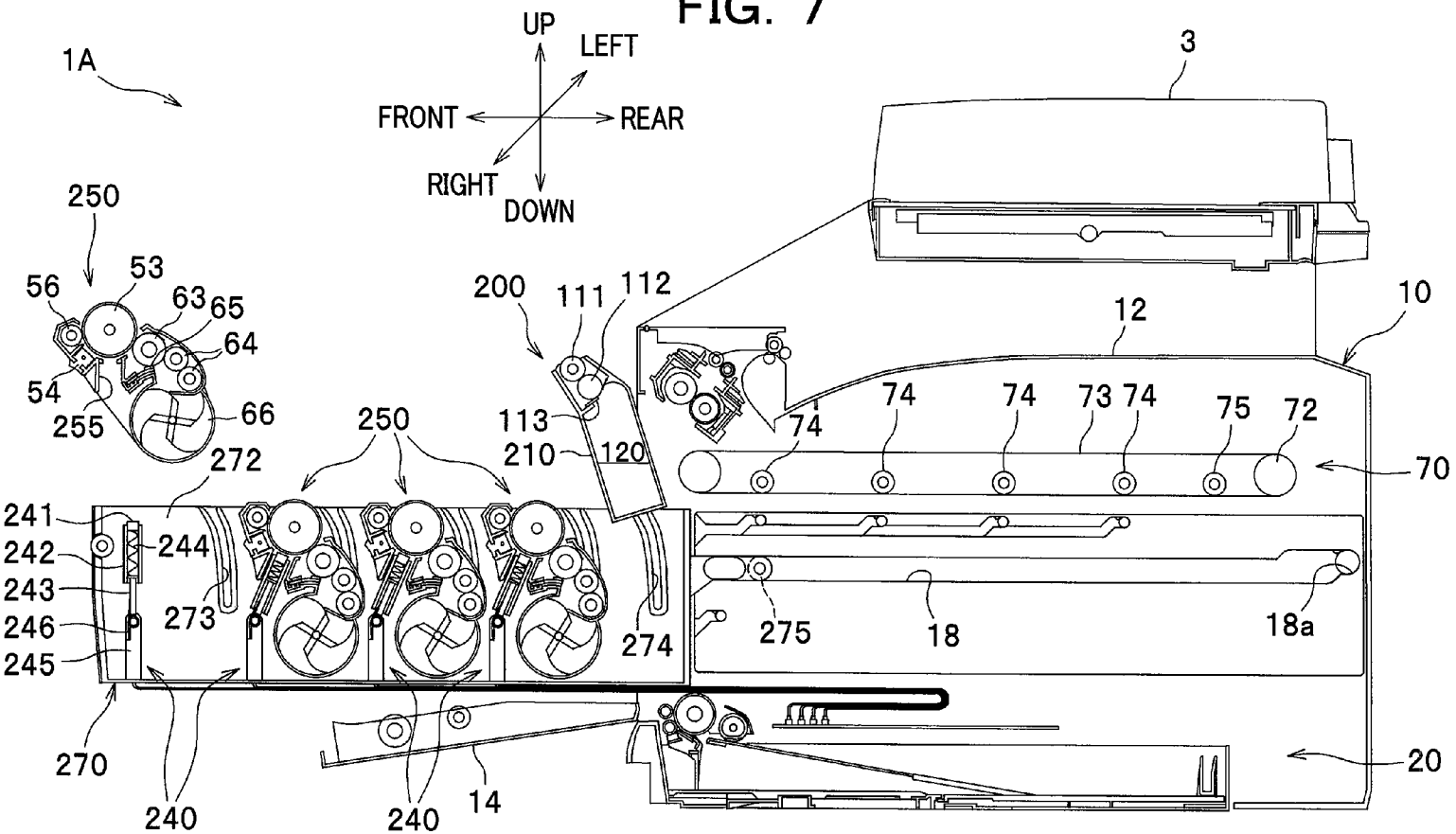
FIG. 7 is a sectional view showing a state in which the support member has been pulled out.

As seen in FIGS. 6 and 7, the process cartridges 250 are arranged in tandem in the front-and-rear direction with the photoconductor drums 53 face (upward) to the intermediate transfer belt 73. The process cartridges 250 are detachably mounted to the support member 270. The photoconductor drums 53 of the process cartridges 250 contact with the intermediate transfer belt 73 when the support member 270 is received at a predetermined position in the main body 10.

As seen in FIG. 7, the process cartridge 250 integrally comprises the photoconductor drum 53, a charger 54, a cleaning roller 56, a developing roller 63, supply rollers 64, a doctor blade 65, and a toner storage chamber 66. The parts of the process cartridge 250 are the same in function as those of the first embodiment, and detailed description thereof will be omitted.

The process cartridge 250 has an exposure opening 255 for inserting the LED unit 240. The four process cartridges 250 are substantially the same in construction with each other except for the color of toner T to be stored therein.

The cleaning unit 200 is arranged in line with the process cartridges 250 in the front-and-rear direction with the cleaning roller 111 facing (upward) to the intermediate transfer belt 73. The cleaning unit 200 is positioned upstream from the process cartridges 250 as seen in the traveling direction of the intermediate transfer belt 73. The cleaning unit 200 is detachably mounted to the support member 270.

As seen in FIG. 7, the cleaning unit 200 has a frame 210 made by a hollow member whose upper part is open. The cleaning roller 111 is rotatably supported at the upper end of the frame 210. The collecting roller 112 is rotatably supported in the cleaning unit 200 below the cleaning roller 111. A space below the collecting roller 112 is defined as a waste toner box 120 for storing collected waste toner T. A blade 113 is provided below the collecting roller 112 so that waste toner T is scraped off by the blade 113 and dropped into the waste toner box 120.

As seen in FIG. 7, the LED unit 240 includes an LED head 241 as an example of an exposure member. The LED head 241 is mounted to a tubular frame portion 242 at the upper end of the frame portion 242. A rod-like arm portion 243 is inserted into the frame portion 242 from the lower end of the frame portion 242. A coil spring 244 is provided inside the frame portion 242 so that the LED head 241 is urged upward by the coil spring 244. The lower end of the arm portion 243 is rotatably mounted to a supporting portion 245 that protrudes from the inner bottom surface of the support member 270. A torque spring 246 is provided at a rotary shaft of the arm portion 243. The arm portion 243 is urged to its upright position by the torque spring 246.

The LED unit 240 is configured such that when the process cartridge 250 is attached to the support member 270, the arm portion 243 is bent relative to the supporting portion 245 by the upper end of the LED unit 240 being forced to be inserted into an exposure opening 255 of the process cartridge 250. Further, the LED unit 240 is configured such that when the process cartridge 250 is removed from the support member 270, the arm portion 243 moves to its upright position relative to the supporting portion 245 by the LED unit 240 being released from the exposure opening 255.

The support member 270 has guide grooves 273, 274 in the inner surface of each of the right and left side walls 272 (see FIG. 7), which guide insertion and removal of the process cartridge 250 and the cleaning unit 200, respectively. A guide roller 275 is provided at the rear end of each side wall 272, extending outward from the side wall 272. The guide roller 275 guides the support member 270 upon its insertion into and removal from the main body 10. Meanwhile, a guide rail 18 engageable with the guide roller 275 is provided at an inner surface of each side wall of the main body 10. A rear end portion 18*a* of the guide rail 18 is one step higher than the rest of the guide rail 18. Because the guide roller 275 slides along the guide rail 18, the support member 270 can be smoothly inserted into or pulled out from the main body 10 of the color printer 1A.

As seen in FIG. 7, when the user performs the maintenance of the cleaning unit 200, the support member 270 is pulled out from the main body 10 of the color printer 1A after the front cover 14 is opened. By this operation, the four process cartridges 250 and the cleaning unit 200 which are mounted to the support member 270 are pulled out from the main body 10. When the user pulls out the support member 270, the guide roller 275 moves down by one step from the rear end portion 18*a* of the guide rail 18, so that the support member 270 entirely moves down. Therefore, it is possible to prevent the photoconductor drums 53 from frictionally contacting with the intermediate transfer belt 73.

Thereafter, as shown in FIG. 7, the cleaning unit 200 is removed from the support member 270 so as to replace it with a new cleaning unit 200 or to dispose of toner T stored in the waste toner box 120.

As with the maintenance of the cleaning unit 200, when the user performs the maintenance of the process cartridge 250, he can pull out the support member 270 with the front cover 14 being opened. Thereafter, the user pulls out the process cartridge 250 from the support member 270 to replace it with a new process cartridge 250.

According to the color printer 1A as constructed above, the same advantageous effects can be obtained as those of the color printer 1 according to the first embodiment.

Third Embodiment

Figure 8:
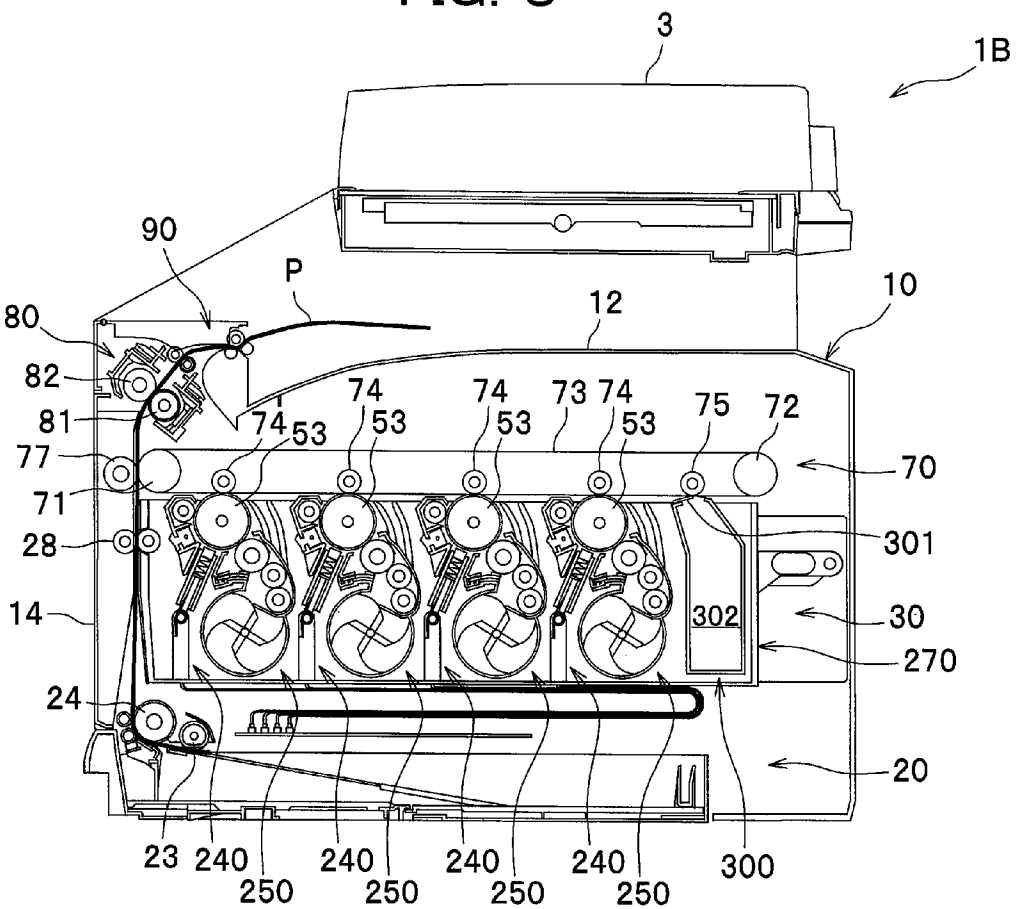
FIG. 8 is a sectional view of the overall configuration of a color printer according to a third embodiment of the present invention.

With reference to FIG. 8, a color printer 1B according to a third embodiment of the present invention will be described.

The color printer 1B according to the third embodiment is substantially the same in construction as the color printer 1A according to the second embodiment except for the cleaning unit 300.

To be more specific, the cleaning unit 300 includes a cleaning blade 301 which contacts with the intermediate transfer belt 73. The cleaning blade 301 is a thin plate-like elongated member, for example, made of urethane rubber. The cleaning blade 301 extends in the right-and-left directions at the upper end portion of the cleaning unit 300. It is noted that the cleaning unit 300 does not comprise a cleaning roller and a collecting roller unlike the cleaning unit 100 (see FIG. 2) provided with the cleaning roller 111 and the collecting roller 112.

Because the cleaning blade 301 contacts with the intermediate transfer belt 73, toner T adhering to the intermediate transfer belt 73 is scraped off and dropped into the waste toner box 302.

According to the color printer 1B as constructed above, the same advantageous effects can be obtained as those of the color printer 1 according to the first embodiment. Further, the cleaning unit 300 can be simplified and light-weighted.

Although the present invention has been described in detail with reference to the above embodiments and the accompanying drawings, the present invention is not limited to these specific embodiments and various changes and modifications may be made without departing from the scope of the appended claims.

In the above preferred embodiments, the roller-shaped cleaning roller 111 and the blade-shaped cleaning blade 301 are employed as a cleaning member. However, the present invention is not limited to these specific constructions. For example, a brush-shaped cleaning member may be employed.

In the above preferred embodiments, the present invention has been applied to a color printer. However, the present invention is applicable to other image forming apparatuses such as a copying machine and a multifunction device.

What is claimed is:

1. An image forming apparatus for transferring toner images formed on a plurality of photoconductors onto a recording sheet comprising:

a main body casing;

a plurality of cartridges each configured to store developer;

a support member configured to support the plurality of cartridges and to be movable, while supporting the cartridges, between an inside position where the support member is inside the main body casing and an outside position where the support member is outside the main body casing;

an intermediate transfer belt disposed under the support member, opposite to the plurality of photoconductors, and configured to accept toner images from the plurality of photoconductors and to transfer a complete image onto a recording sheet;

a sheet feeding unit disposed under the intermediate transfer belt;

a conveyance guide arranged between the sheet feeding unit and the intermediate transfer belt and configured to guide the recording sheet:

a fixing unit disposed upstream from the support member in a first direction along which the support member moves from the inside position to the outside position and configured to fix the complete image on the recording sheet;

a cleaning unit disposed between the fixing unit and the plurality of cartridges in the first direction, wherein the cleaning unit includes a cleaning member configured to collect waste toner adhering to the intermediate transfer belt, and a receptacle configured to store the waste toner collected by the cleaning member; and a waste toner carrier unit including at least one carrying member configured to carry the waste toner collected by the cleaning member in an axial direction thereof.

2. The image forming apparatus according to claim 1, wherein the conveyance guide comprises a plurality of conveyance rollers.

3. The image forming apparatus according to claim 1, wherein the fixing unit is arranged to overlap the plurality of cartridges as viewed from the first direction.

4. The image forming apparatus according to claim 1, wherein the support member comprises guided members configured to be guided by guide members provided in the main body casing when the support member moves between the inside position and the outside position, and wherein, as viewed from a vertical direction, the guided members overlap the fixing unit when the support member is positioned in the inside position.

5. The image forming apparatus according to claim 1, wherein the main body casing has a first opening through which the support member is movable between the inside position and the outside position, and a second opening through which the sheet feeding unit is detachably attached to the main body casing, and wherein the image forming apparatus further comprising a first cover for opening and closing the first opening, and a second cover for opening and closing the second opening.

6. The image forming apparatus according to claim 1, wherein the fixing unit is configured to convey the recording sheet from a lower side to an upper side of the fixing unit.

* * * * *